United States Patent [19]

Ohta et al.

[11] Patent Number: 4,927,457

[45] Date of Patent: May 22, 1990

[54] METHOD OF MANUFACTURING LOW CARBON FERRO-CHROMIUM

[75] Inventors: Kazumi Ohta; Sotoaki Kawaguchi; Hisao Doyama; Yutaka Yano, all of Tokyo, Japan

[73] Assignee: Nippon Kokan Kabushiki Kaisha, Tokyo, Japan

[21] Appl. No.: 272,806

[22] PCT Filed: Feb. 1, 1988

[86] PCT No.: PCT/JP88/00085

§ 371 Date: Sep. 28, 1988

§ 102(e) Date: Sep. 28, 1988

[87] PCT Pub. No.: WO88/05829

PCT Pub. Date: Aug. 11, 1988

[30] Foreign Application Priority Data

Feb. 2, 1987 [JP] Japan ..... 62-22156
Feb. 6, 1987 [JP] Japan ..... 62-24785

[51] Int. Cl.[5] ..... C22B 4/00

[52] U.S. Cl. ..... 75/10.63; 75/10.51; 75/10.52

[58] Field of Search ..... 75/10.63, 10.51, 10.52

[56] References Cited

U.S. PATENT DOCUMENTS 2,001,015 5/1935 Feild ..... 75/10.63
3,854,932 12/1974 Bishop ..... 75/51.2

*Primary Examiner*—Peter D. Rosenberg
*Attorney, Agent, or Firm*—Frishauf, Holtz, Goodman & Woodward

[57] ABSTRACT

Ores including oxides of Cr and Fe and melted by means of a furnace, thereby forming molten metal. The molten metal is poured from the furnace into a ladle. A reducing agent, such as SiCr, is added to the molten metal in the ladle. Then, an oxidizing gas or an inert gas is introduced into the molten metal at a rate of more than 7.0 l/min. but not exceeding 29.0 l/min., for each ton of the molten metal, thereby bubbling and stirring the molten metal. Alternatively, an oxidizing gas or an inert gas is introduced into the molten metal, thus bubbling the molten metal and, thus, lowering the temperature of the molten metal to a desired value, and then the molten metal is reladled, thereby to decrease the nitrogen content of the molten metal to a desired value.

12 Claims, 4 Drawing Sheets

FIG. 3
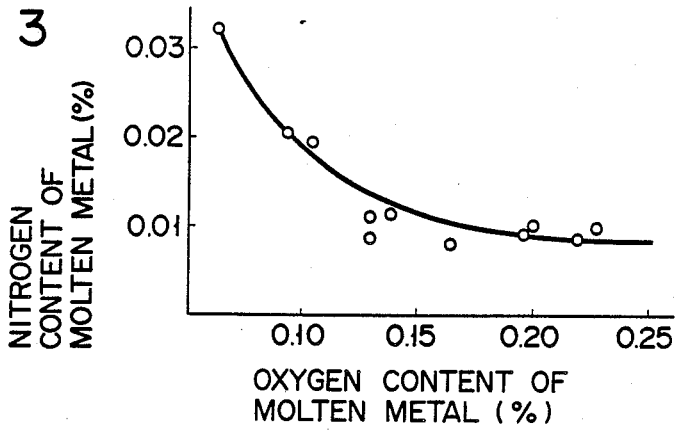
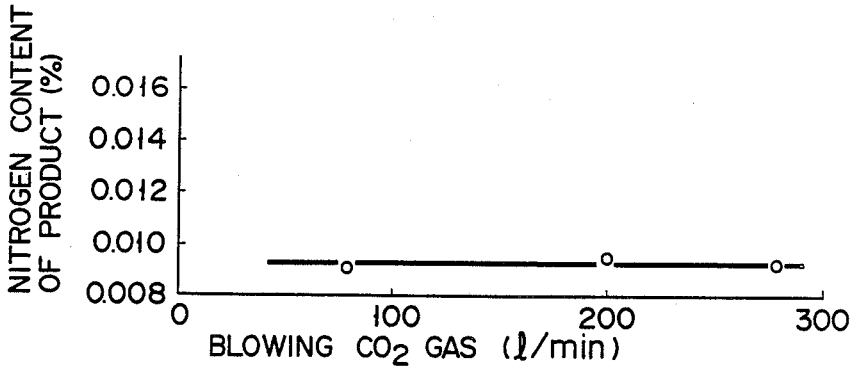
FIG. 4
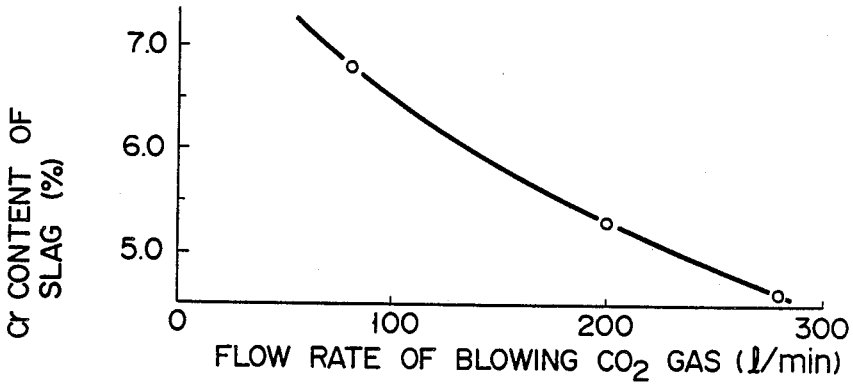
FIG. 5

METHOD OF MANUFACTURING LOW CARBON FERRO-CHROMIUM

TECHNICAL FIELD

The present invention relates to a method of manufacturing low carbon ferro-chromium whose nitrogen content is extremely low and whose Cr yield is sufficiently high.

PRIOR ART

Low carbon ferro-chromium, i.e., a Fe-Cr alloy comprising 60 wt. % or more of Cr and 0.10 wt. % or less of C, is manufactured by the so-called Perrin method, usually in the following procedure. First, Cr ore and calcined lime are supplied into an electric furnace, and are melted therein. The molten slag is poured into a ladle, and an amount of SiCr is added, as a reducing agent, to the molten slag in the ladle. The molten slag containing SiCr is poured from the ladle into another ladle, then from the second ladle into the first ladle. This transfer of the molten metal between two ladles, called "reladling", is repeated several times. As a result, the molten metal and the molten slag are stirred together, thereby accelerating the reduction of the molten metal.

The molten metal contacts air during the reladling and inevitably absorbs nitrogen. Consequently, the low carbon ferro-chromium will have a high nitrogen content. How much nitrogen the molten metal absorbs during the reladling depends on the temperature of the molten metal and the number of times the molten metal contacts air. There are two alternative methods of suppressing the nitrogen absorption. The first altertative is to decrease the basicity of the primary slag within the furnace ($CaO/Cr_2O_3$), thereby to lower the temperature of the molten metal. The second alternative is to perform reladling less times, thus decreasing the number of times the molten metal contacts air.

When the basicity of the primary slag is decreased, however, the electric furnace will consume more power to melt the Cr ore, and the slag will contain more Cr. Further, the ratio of the effectively used amount of each raw material to the total supplied amount will decrease, and the productivity will also decrease. Still further, the linings of the electric furnace and the ladles will likely be eroded.

On the other hand, when the ladling is repeated less times, the reducing of the molten slag does not proceed sufficiently fast. The feeding rate of the reducing agent must therefore be decreased. When the reducing agent is fed at a lower rate, then the Cr content in the slag will rise, inevitably lowering the yield of Cr very much. In this case, too, consumption efficiency of each raw material will decrease, and the productivity will also decrease.

Hence, the manufacturing cost of the low carbon ferro-chromium is high, no matter whether the basicity of the primary slag is decreased, or the reladling is repeated is decreased less times. In either conventional method of suppressing the nitrogen absorption, it is difficult to maintain the nitrogen content of the molten metal at a desired value.

Accordingly it is an object of the present invention to provide a method of manufacturing low carbon ferro-chromium whose nitrogen content is extremely low and whose Cr yield is sufficiently high.

Another object of this invention is to provide a method of manufacturing low carbon ferro-chromium, wherein the nitrogen content of molten metal can be controlled and maintained at a low level.

DISCLOSURE OF THE INVENTION

According to a first aspect of the invention, there is provided a method of manufacturing low carbon ferro-chromium, comprising the steps of melting ores including oxides of Cr and Fe by means of a furnace, thus forming molten slag; pouring the molten slag into a ladle; adding a reducing agent to the molten slag in the ladle; and introducing an oxidizing gas or an inert gas into the melt in the ladle, thereby bubbling the molten metal and accelerating reduction of the molten slag, said gas being introduced into the melt metal at a rate of more than 7.0 l/min. but not exceeding 29.0 l/min, for each ton of the melt in the ladle.

According to a second aspect of the invention, there is provided a method of manufacturing low carbon ferro-chromium, comprising the steps of melting ores including oxides of Cr and Fe by means of a furnace, thus forming molten slag; pouring the molten slag into a ladle; adding a reducing agent to the molten slag in the ladle; introducing an oxidizing gas or an inert gas into the molten metal in the ladle, thereby bubbling the molten metal and accelerating reduction of the molten metal; and reladling the molten metal a number of times after the temperature of the molten metal has been lowered by the bubbling, thereby to control nitrogen content of the molten metal.

According to the present invention, an oxidizing gas or an inert gas is introduced into a melt in the ladle, thereby bubbling the melt and, hence, stirring the molten metal and slag together. Owing to the bubbling, the temperature of the molten metal falls, and the cooled molten metal can be reduced while being prevented from contacting air. Therefore, the nitrogen content of the molten metal can be lowered very much. Since the stirring gas is fed into the melt in the ladle at a rate of more than 7.0 l/min. but not exceeding 29.0 l/min, for each ton of the melt in the ladle, the melt can be stirred so strongly that the reducing agent can effectively reacts with the oxides of Cr and Fe, thereby to provide a high yield of Cr. Therefore, a relatively small amount of electric power suffices to make a unit amount of molten ferro-chromium, and low carbon ferro-chromium can be manufactured at low cost. Moreover, since the molten metal is reladled a proper number of times, after the temperature of the molten metal has been lowered by means of the bubbling, the nitrogen content of the molten metal can be controlled and maintained at a low level.

BRIEF DESCRIPTION OF THE DRAWINGS

FIG. 3 is a graph representing the relationship between the oxygen content of the molten metal and the nitrogen content thereof;

FIG. 4 is a graph showing the relationship between the flow rate of $CO_2$ gas and the nitrogen content of the product;

FIG. 5 is a graph showing the relationship between the Cr content of the slag and the flow rate of $CO_2$ gas;

BEST MODE FOR CARRYING OUT THE INVENTION

Embodiments of the present invention will now be described, with reference to the accompanying drawings.

Figure 1:
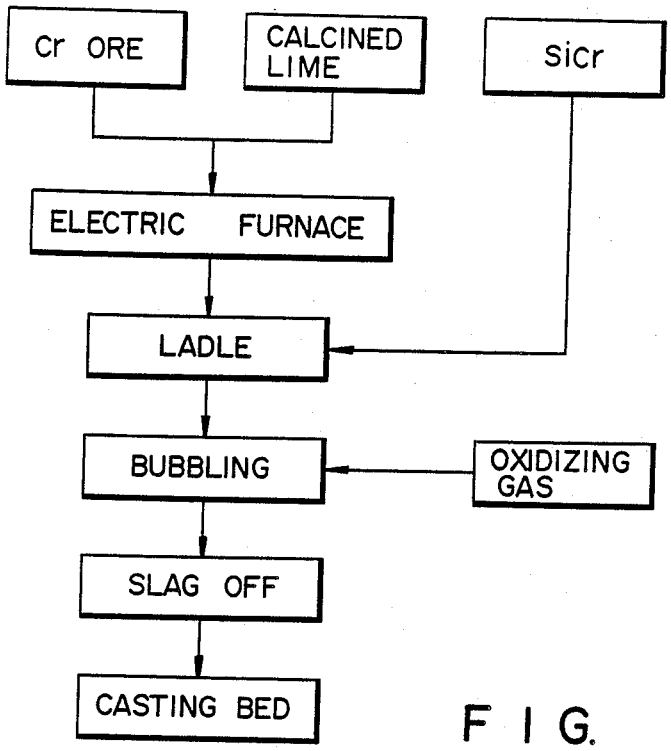
FIG. 1 is a flow chart explaining a first embodiment of the present invention.

FIG. 1 is a flow chart explaining a first embodiment of the invention. As is shown in this figure, Cr ore and calcined lime are supplied into an electric furnace and are melted, thereby forming molten slag. The molten slag is poured into a ladle. Then, SiCr (silicon-chromium) is added to the molten slag in the ladle. SiCr can be added to the molten slag, either in the form of a solid, or after having been heated. Alternatively, SiCr can be melted by means of another electric furnace and then added to the molten slag in the ladle. Thereafter, a lance made of refractory materials is inserted into the melt contained in the ladle. $CO_2$ gas is applied through the lance into the melt (the molten slag and the molten metal), thereby bubbling the molten metal and molten slag together. Due to the bubble-stirring, the reactions represented by the following formulae (1) and (2) are accelerated, whereby the Cr oxide and the Fe oxide, both contained in the Cr ore, are reduced with the silicon contained in the siliconchromium.

$$2Cr_2O_3+3Si=4Cr+3SiO_2+90.6Kcal \quad (1)$$

$$2FeO+Si=2Fe+SiO_2+83.8Kcal \quad (2)$$

As a result, low carbon ferro-chromium is produced which comprises 60 wt. % or more of Cr and 0.10 wt. % or less of C. $SiO_2$, which is the product of the reactions (1) and (2), combines with CaO contained in the calcined lime, thereby forming slag, as may be understood from the following formula (3):

$$SiO_2+2CaO=Ca_2SiO_3-483Kcal \quad (3)$$

In order to complete the reduction represented by formulae (1) and (2), it is desirable that high basic operation be performed, thereby to accelerate the reaction of formula (3). This is why calcined lime is supplied, along with Cr ore, into the electric furnace.

As $CO_2$ gas is applied into the melt, the Si content of the molten metal decreases, and the temperature thereof falls a little. This temperature fall suppresses the nitrogen absorption into the molten metal.

Instead of $CO_2$ gas, another oxidizing gas, such as CO gas, $O_2$ gas or water vapor ($H_2O$), can be used as the gas for bubbling the molten metal. Alternatively, an inert gas, such as Ar gas or He gas, can be used to bubble the molten metal. Further, a mixture of an oxidizing gas and an inert gas can be used for the same purpose. When such a gas is applied into the molten metal throng the lance, as has been described above, the gas changes into bubbles, which rises in the molten metal. As a result, the molten metal is stirred.

Figure 2:
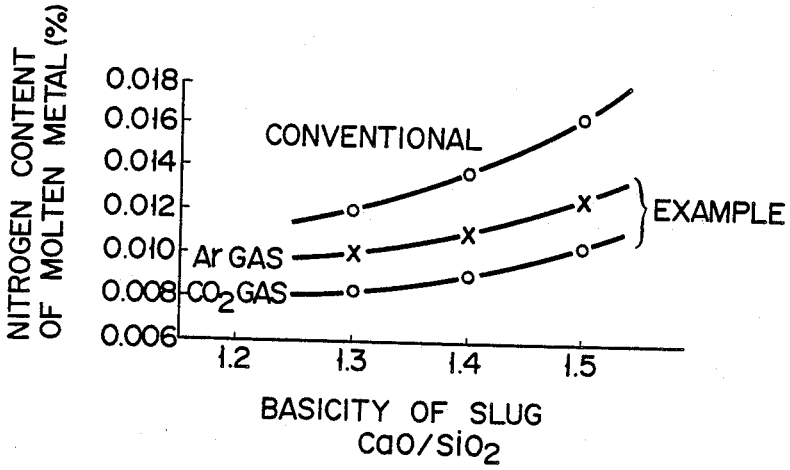
FIG. 2 is a graph showing the relationships which the nitrogen content of molten metal and the basicity of slag exhibit when different bubbling gates are used.

The nitrogen content of the molten metal can be more reduced when an oxidizing gas bubbles and stirs the molten metal than when an inert gas bubbles and stirs the melt. FIG. 2 shows the relationships between the nitrogen content of the melt and the basicity of the slag, which are observed when Perrin method is carried out, when the molten metal is stirred with Ar gas, and when the molten metal is stirred with $CO_2$ gas. As is clearly demonstrated in FIG. 2, the nitrogen content of the melt is more decreased when the melt is stirred with $CO_2$ gas than when the melt is stirred with Ar gas. This is because Ar gas shields the molten metal from the atmosphere and lowers the partial pressure of $N_2$ gas, whereas $CO_2$ gas not only shuts the molten metal off the atmosphere and reduces the $N_2$ partial pressure, but also is decomposed at high temperature into CO gas and $O_2$ gas, whereby the $O_2$ suppresses the nitrogen absorption into the molten metal.

FIG. 3 is a graph representing the relationship between the oxygen content of the molten metal and the nitrogen content of the molten metal. As is evident from this figure, the higher the oxygen content of the molten metal, the lower the nitrogen content thereof. In other words, $O_2$ gas serves to suppress the $N_2$ absorption into the molten metal.

The gas for stirring the melt is introduced into the melt at a rate of more than 7.0 l/min., but not exceeding 29.0 l/min., for each ton of the melt. FIG. 4 shows the relationship between the flow rate of $CO_2$ gas and the nitrogen content of the product, which is observed when the melt consists of 8 tons of primary slag and 2.45 tons of SiCr. As is clearly understood from this figure, the nitrogen content of the product remains unchanged even if the flow rate of $CO_2$ gas is increased. Obviously, the nitrogen content does not increase even if the flow rate of $CO_2$ gas is raised. FIG. 5 illustrates the relationship between Cr content of the slag and the flow rate of $CO_2$ gas (10.45 ton of the melt). As this figure shows, the higher the flow rate of $CO_2$ gas, the lower the Cr content of the slag, and the higher the Cr yield in the product. It is therefore desirable that $CO_2$ gas be introduced into the molten metal at as high a flow rate as possible, so as to raise the Cr yield in the product. When the flow rate of $CO_2$ is raised for this purpose, the $N_2$ absorption into the molten metal is not promoted at all.

Table 1, given blow, shows the nitrogen contents and Cr yields of two examples of low carbon ferro-chromium of this invention, the nitrogen content and Cr yield of low carbon ferro-chromium manufactured by Perrin method, and the nitrogen content and Cr yield of a controller made by introducing $CO_2$ gas into the molten metal at a relatively low rate. Examples 1 and 2 have been made under specific conditions which will be described later.

TABLE 1

| | $Cr_2O_3$ in slug % | N Content of Product % | N Acceptance % 0.015% | N Acceptance % 0.010% | Yield of Cr % | Electric Power (KWH) |
|---|---|---|---|---|---|---|
| Example 1 | 7.8 | 0.009 | 100 | 90 | 83.0 | 2500 |
| Example 2 | 6.7 | 0.009 | 100 | 90 | 84.0 | 2450 |
| Controller | 10.0 | 0.009 | 100 | 90 | 80.0 | 2800 |
| Prior | 5.4 | 0.040 | — | — | 90.9 | 2400 |

TABLE 1-continued

| | $Cr_2O_3$ in slag % | N Content of Product % | N Acceptance % 0.015% | N Acceptance % 0.010% | Yield of Cr % | Electric Power (KWH) |
|---|---|---|---|---|---|---|
| Art | | | | | | |

In Table 1, the content or $Cr_2O_3$ in the slag, and the nitrogen content of the product are given in percent by weight. N acceptance is shown for two kinds of products, one containing 0.015 wt. % or less of nitrogen, the other containing 0.010 wt. % or less of nitrogen. The yield of Cr is given in percentage, and the electric power is given in KWH, which is required to provide one ton of molten ferro-chromium. Example 1 has been produced by applying $CO_2$ gas into the melt for 10 minutes at 200 l/min., thereby bubbling the melt. Example 2 has been made by introducing $CO_2$ gas into the melt for 10 minutes at 280 l/min., thereby bubbling the melt. The controller has been made by introducing $CO_2$ gas into the melt for 10 minutes at 80 l/min., thereby bubbling the melt. The prior art product has been made Perrin method, in which the melt is reladled five times. Examples 1 and 2, the controller, and the prior art product are identical in the basicity of the primary slag ($CaO/SiO_2$), i.e., 1.40.

As Table 1 clearly shows, the prior art product has a high nitrogen content of 0.040% though its Cr yield is as high as 90%; it cannot be a low-nitrogen ferro-chromium whose nitrogen content is 0.015% or less. In the case of the controller, the N acceptance is 100% for low-nitrogen products containing 0.015% or less of nitrogen, and is 90% for the ultra-low nitrogen products containing 0.010% or less. Nonetheless, the Cr yield of the controller is 80% and relatively low, and much power i.e., 2800 KWH, is required to provide one ton of the molten metal. In contrast, Examples 1 and 2 have higher Cr yields than that of the controller, i.e., 83% and 84%, respectively, despite the fact that their N acceptances are the same as that of the controller for both the low-nitrogen product and the ultra-low nitrogen product. Since Examples 1 and 2 have a high Cr yield, less power suffices to provide one ton of the molten metal—2500 KWH for Example 1, and 2450 KWH for Example 2.

Either example achieves a higher N acceptance than the prior art product, for both a low-nitrogen product and an ultra-low nitrogen product. In addition, either example has a higher Cr yield than the controller. That is, Examples 1 and 2 have an optimum N acceptance and an optimum Cr yield. To manufacture low carbon ferro-chromium which exhibits an N acceptance and a Cr yield, both as high as those of Example 1 or Example 2, $CO_2$ must be introduced into the melt at the rate of 80 l/min. or more, as may be understood from FIGS. 4 and 5. When the flow rate of $CO_2$ gas exceeds 300 l/min., however, the gas bubbles the melt too violently, and the Cr yield cannot increase effectively, while the running cost for manufacturing the product rises due to the increase in the consumption of $CO_2$ gas. Hence, in the present invention, the flow rate of the stirring gas ($CO_2$) is set at the value of more than 80 l/min., but not exceeding 300 l/min.,—that is, 7.0 to 29.0 l/min. for one ton of the melt.

After the melt has been bubbled and stirred for a predetermined period of time, the slag is removed from the surface of the molten metal in the ladle, thus obtaining molten low carbon ferro-chromium. The molten ferro-chromium is poured from the ladle into the molds placed on the casting bed.

Figure 6:
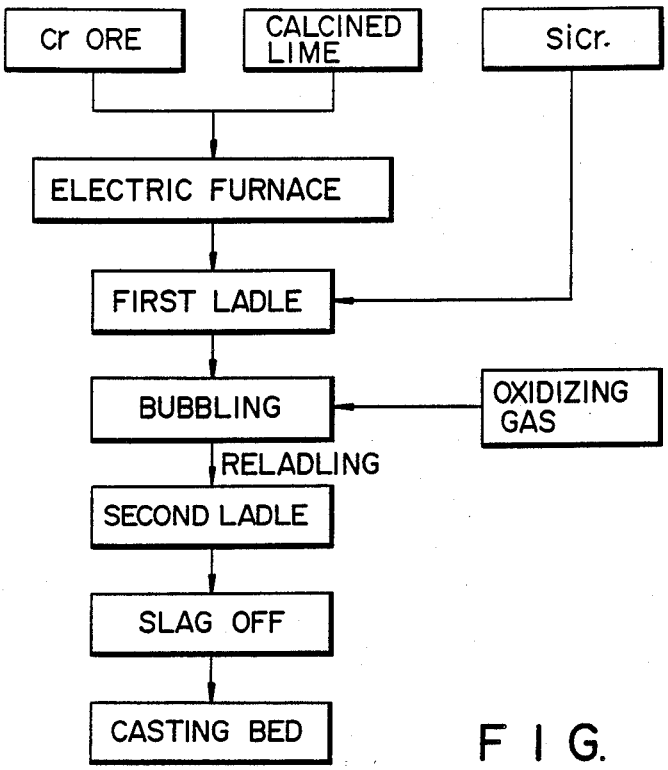
FIG. 6 is a flow chart explaining a second embodiment of the invention.
Figure 7:
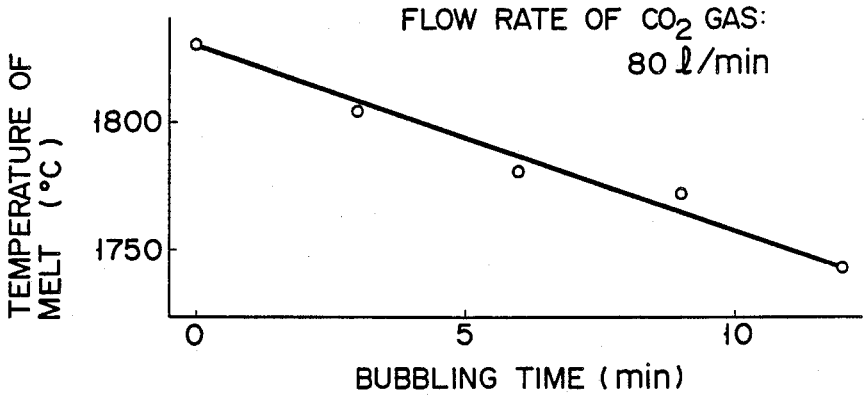
FIG. 7 is a graph illustrating the relationship between the temperature of the molten metal and the time for which the molten metal has been bubbled.

A second embodiment of the present invention will now be described. As is illustrated in the flow chart of FIG. 6, two ladles are used in this embodiment. As in the first embodiment, Cr ore and calcined lime are supplied into an electric furnace and are melted therein, and the resultant molten slag is poured into a first ladle. Then, also as in the first embodiment, SiCr is added to the molten slag, and $CO_2$ gas is applied into the melt (the molten slag and the molten metal), thereby bubbling and stirring the melt. The stirring gas is introduced into the melt at an appropriate flow rate, thus suppressing the nitrogen absorption into the molten metal. FIG. 7 shows the relationship between the temperature of the molten metal and the time for which the molten metal has been bubbled, said relationship being observed when $CO_2$ is introduced into the molten metal at the rate of 80 l/min. As FIG. 7 reveals, the temperature of the melt is inversely proportionate to the bubbling time. The stirring gas is not limited to $CO_2$. $CO_2$ gas can be replaced by other oxidizing gas, such as CO gas or water vapor ($H_2O$), or by an inert gas, such as Ar gas or He gas. Further, instead of applying an oxidizing gas or an inert gas into the molten metal, a substance, such as $CaCO_3$, $CaF_2$, or $Na_2CO_3$, which is decomposed at high temperatures and generates an oxidizing gas, can be added to the melt. When such a substance is added to the molten metal, it is decomposed, generating an oxidizing gas such as $CO_2$. The oxidizing gas rises it the melt, in the form of bubbles, whereby the melt is stirred. The substance can be used, along with an oxidizing gas such as $CO_2$ gas and/or at inert gas such as Ar gas, in order to stir the molten metal.

After the melt has been bubbled and stirred, it is transferred from the first ladle into a second ladle. In other words, the melt is reladled. During this reladling, the molten metal of the melt contacts air and absorbs nitrogen. As a result, the nitrogen content of the molten metal rises. If necessary, the melt is transferred from the second ladle into the first ladle, and then back into the second ladle. Such reladling is performed once or several times until the nitrogen content of the molten metal changes to a predetermined value. Then, the slag is removed from the surface of the molten metal in the ladle (either, the first or the second), thus obtaining molten, low carbon ferro-chromium. The molten ferro-chromium is poured into the molds placed on the casting bed.

Figure 8:
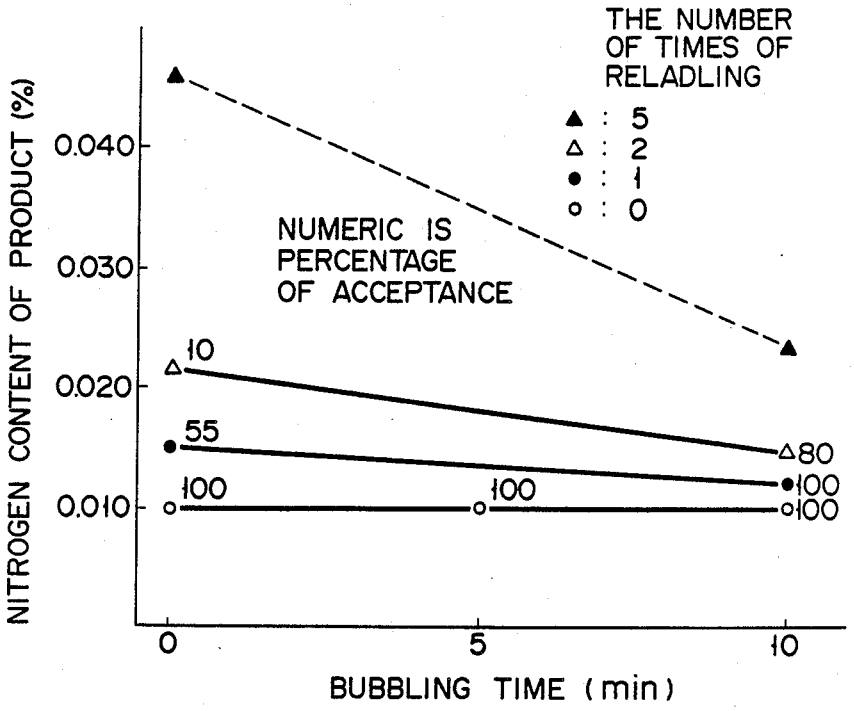
FIG. 8 is a graph showing the relationship between the number of times the molten metal has been reladled, the time for which the molten metal has been bubbled, and the nitrogen content of the product.

Low carbon ferro-chromium having any desired nitrogen content can be manufactured by bubbling and reladling the molten metal. FIG. 8 represents the relationship between the number of times the molten metal has been reladled, the bubbling time, and the nitrogen content of the low carbon ferro-chromium. Table 2, given below, shows the nitrogen contents of various types of ferro-chromium, in percentage by weight.

TABLE 2

| | |
|---|---|
| Ordinary Product | 0.030–0.050 |
| Low Nitrogen Product | 0.011–0.015 |
| Ultra-low Nitrogen Product | 0.010 or less |

As is evident from FIG. 8, when the bubbling time is 0 minute and no reladling is performed, the resultant product has a nitrogen content of 0.010%. The greater the number of reladlings, the higher the nitrogen content of the product. When the molten metal is not bubbled and reladled five times, the resultant product has an extremely high nitrogen content of 0.046%. The numerical values given in FIG. 8 are the acceptance ratios (t) for products whose nitrogen content is 0.015% or less. The product made by not bubbling the molten metal and reladling the molten metal once has an acceptance ratio of 55%. The product made by not bubbling the melt and reladling the melt twice has an acceptance ratio of 10%. When the melt is not bubbled and stirred as in the manufacture of the prior art product, the molten metal is not thoroughly reduced unless the melt is repeatedly reladled, for example, five times or so. If the melt is reladled so many times, it is impossible to make a product whose nitrogen content is 0.015% or less. In contrast, the product made by bubbling the melt and not reladling the melt has too low a nitrogen content of 0.010%, and cannot be a low nitrogen ferro-chromium whose nitrogen content ranges from 0.011 to 0.015% as is shown in Table 2.

According to the present invention, the melt is bubbled and then reladled, thereby to manufacture low nitrogen products whose acceptance ratios are very low and whose nitrogen content falls within a prescribed range. As can be understood from FIG. 8, the product which has been made by bubbling the melt for 10 minutes has a lower nitrogen content than the product which has been made by not bubbling the melt metal at all, though both products have been obtained by reladling the melt the same number of times, that is, once or twice. This is because, as is evident from FIG. 7, the longer the bubbling time, the lower the temperature of the melt; and hence, the absorption of nitrogen into the molten metal is suppressed. Thus, in order to minutely adjust the nitrogen content of the molten metal, the melt is bubbled, thus lowering the temperature of the melt, and then is reladled, thereby adjusting the nitrogen content of the molten metal to the value of 0.015% or less, with high accuracy.

Figure 9:
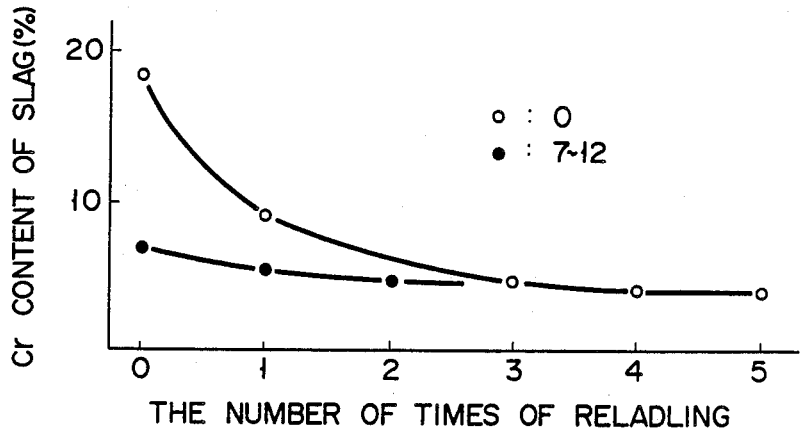
FIG. 9 is a graph representing the relationship between the number of times the molten metal has been reladled, the time for which the molten metal has been bubbled, and the Cr content of the slag.

FIG. 9 represents the relationship between the number of times the molten metal has been reladled, the bubbling time, and the Cr content of the slag. As can be clearly seen from FIG. 9, when the melt is not bubbled at all as in the conventional method, the Cr content of the slag cannot fall to a sufficiently low level unless the melt is reladled three times, four times, or more. In contrast, when the melt is bubbled for 7 to 12 minutes as in the present invention, the Cr content of the slag is as low as 7.0% even if the melt is not reladled at all. When the molten metal is bubbled for 7 to 12 minutes and then reladled once or twice, the Cr content of the slag is reduced to an extremely small value of 4.5 to 5.5%. As a result, the Cr content of the molten ferro-chromium rises in an extremely short time, thus increasing the Cr yield in the product. Obviously, the method of the invention can manufacture low carbon ferro-chromium with high productivity.

Table 3, given below, shows the Cr yields and nitrogen contents of Examples 3 and 4 made by the method according to the second embodiment, the Cr yield and nitrogen content of a controller made by not reladling the melt, and the Cr yield and nitrogen content of a prior art product. Examples 3 and 4 have been manufactured under the particular conditions which will be specified later.

TABLE 3

| | $Cr_2O_3$ in slag | N Content of Product | Distribution of N content % | | | Yield of Cr | Electric Power |
|---|---|---|---|---|---|---|---|
| | % | % | I | II | III | % | (KWH) |
| Example 3 | 7.8 | 0.012 | 0 | 90 | 10 | 83.0 | 2650 |
| Example 4 | 6.8 | 0.014 | 5 | 95 | 0 | 84.0 | 2600 |
| Controller | 10.0 | 0.009 | 0 | 10 | 90 | 80.0 | 2800 |
| Prior Art | 5.4 | 0.040 | 100 | 0 | 0 | 90.0 | 2400 |

In Table 3, the $Cr_2O_3$ content in the slag and the nitrogen content of the product are given in percent by weight. The distribution of the nitrogen content is represented in percentage, for product I whose nitrogen content is 0.016 wt. % or more, product II whose nitrogen content ranges from 0.011 wt. % to 0.015 wt. %, and product III whose nitrogen content is 0.010 wt. % or less. The yield of Cr is given in percentage, whereas the power is given in KWH, which is required to provide one ton of molten ferro-chromium. Example 3 has been made by applying $CO_2$ gas into the melt for 10 minutes, thereby bubbling and stirring the melt, and then by reladling the melt one time. Example 4 has been produced by introducing $CO_2$ gas into the melt for 10 minutes, thus bubbling and stirring the melt, and then by reladling the melt two times. The controller has been prepared by bubbling and stirring the melt in the same way, and then by not reladling the melt at all. The prior art product has been made Perrin method in which the melt is reladled five times.

As is clearly tnderstood from Table 3, the prior art product has a high nitrogen content, and all samples thereof contained 0.016 wt. % or more of nitrogen. As for the controller, only 10% of the samples have a nitrogen content ranging from 0.011 to 0.015 wt. %, and are low nitrogen products, and 90% of the samples have a nitrogen content of 0.010 wt. % or less and are ultra-low nitrogen products. The Cr content of the controller is, however, as low as 80%, and a relatively large amount of electric power is required to produce one ton of the controller. In contrast to the prior art product and the controller, most samples of Examples 3 and 4 are low nitrogen products—90% for Example 3 and 95% for Example 4, as is evident from Table 3. Moreover, the Cr content of either example is higher than that of the controller. Therefore, less electric power is consumed to manufacture one ton of Example 3 or 4 than to produce one ton of the controller. It should be noted that Example 3, which has been prepared by reladling the melt one time, has a nitrogen content of 0.012 wt. %, whereas Example 4, which has been made by reladling the melt two times, has a higher nitrogen content of 0.014 wt. %. Hence, the nitrogen content of the product can be adjusted to any desired value with high accuracy by changing the number of times the molten metal is reladled.

Now, it will be described how Examples 1 to 4 have been manufactured.

EXAMPLE 1

Cr ore in an amount of 5280 kg, and calcined lime in an amount of 2600 kg were supplied into an Heroult electric furnace (6000 kVA), and were melted therein, thus forming molten slag. The molten slag was poured into a ladle. Then, 2430 kg of SiCr was added, as a reducing agent, to the primary slag. $CO_2$ gas was then applied into the melt under a pressure of 5 kg/cm$^2$ at 200 l/min. for 10 minutes, through a refractory lance having four outlet ports having a diameter of 4 mm, thereby bubbling and stirring the melt. After the Si content of the molten metal had decreased to 1.0% or less, the slag was removed from the molten metal. The molten metal was then poured from the ladle into molds placed in the casting bed. Table 4 shows the compositions of the primary slag, the molten ferro-chromium, SiCr, and the slug, and also shows the electric power consumed to make one ton of Example 1, and the Cr yield of Example 1.

TABLE 4

| | Weight | Composition (wt. %) | | | |
|---|---|---|---|---|---|
| | | ($Cr_2O_3$) | (FeO) | ($SiO_2$) | (CaO) |
| Primary slag | 7800 | 34.5 | 12.6 | 1.6 | 31.7 |
| | | [Cr] | [Si] | | |
| SiCr | 2430 | 38.8 | 41.0 | | |
| | | [Cr] | [Si] | [C] | [N] |
| Molten Ferr-Cr | 3720 | 62.5 | 0.7 | 0.07 | 0.009 |
| | | ($Cr_2O_3$) | ($SiO_2$) | (CaO) | $CaO/SiO_2$ |
| Slag | 6480 | 7.8 | 27.7 | 38.3 | 1.38 |
| Electric Power | 2500 (KWH/T) | | | | |
| Yield of Cr | 83.0 (%) | | | | |

As is evident from Table 4, a low carbon ferro-chromium could be manufactured which exhibited a nitrogen content of 0.009 wt. %, a carbon content of 0.07 wt. %, and a high Cr yield of 83.0%.

EXAMPLE 2

The same materials as used it Example 1 were supplied into the same electric furnace, in the same amounts as in Example 1, and were melted in the furnace, thereby preparing molten slag. The molten slag was poured into a ladle. Then, 2430 kg of SiCr was added to the molten slag, and $CO_2$ gas was introduced into the melt under a pressure of 5 kg/cm$^2$ at 280 l/min. in the same way as in Example 1, thus bubbling and stirring the melt. The molten metal was then treated and poured into molds, it the same manner as in Example 1. Table 5 shows the compositions of the primary slag, SiCr, the molten metal, and the slag, and also represents the electric power consumed to make one ton of Example 2, and the Cr yield of Example 2.

TABLE 5

| | Weight | Composition (wt. %) | | | |
|---|---|---|---|---|---|
| | | ($Cr_2O_3$) | (FeO) | ($SiO_2$) | (CaO) |
| Primary slag | 7830 | 34.5 | 12.9 | 1.8 | 31.2 |
| | | [Cr] | [Si] | | |
| SiCr | 2420 | 38.8 | 41.0 | | |
| | | [Cr] | [Si] | [C] | [N] |
| Molten Ferr-Cr | 3720 | 62.3 | 0.6 | 0.08 | 0.009 |
| | | ($Cr_2O_3$) | ($SiO_2$) | (CaO) | $CaO/SiO_2$ |
| Slag | 6400 | 6.7 | 28.4 | 39.5 | 1.39 |
| Electric Power | 2450 (KWH/T) | | | | |
| Yield of Cr | 84.0 (%) | | | | |

As is clearly seen from Table 5, Example 2 is also a low carbon ferro-chromium which has a nitrogen content of 0.009 wt. %, a carbon content of 0.08 wt. %, and a high Cr yield 84.0%.

EXAMPLE 3

Cr ore and calcined lime were supplied into an Heroult electric furnace (6000 kVA), in an amount of 5440 kg and an amount of 2710 kg, respectively, and were melted therein, thus forming molten slag. The molten slag was poured into a ladle. Then, 2280 kg of SiCr was added, as a reducing agent, to the primary slag. $CO_2$ gas was then applied into the melt under a pressure of 4 kg/cm$^2$ for ten minutes, through a refractory lance having four outlet ports having a diameter of 4 mm, thereby bubbling the stirring the melt. Thereafter, the melt was reladled one time. Then, after the Si content of the molten metal had decreased to 1.0% or less, the slag was removed from the molten metal. The molten metal was poured into molds placed on the casting bed. Table 6, given below, shows the compositions of the primary slag, SiCr, the molten ferro-chromium, and the slag, and also represents the electric power consumed to produce one ton of Example 3 and the Cr yield Example 3.

TABLE 6

| | Weight | Composition (wt. %) | | | |
|---|---|---|---|---|---|
| | | ($Cr_2O_3$) | (FeO) | ($SiO_2$) | (CaO) |
| Primary slag | 8150 | 32.5 | 12.4 | 2.0 | 37.0 |
| | | [Cr] | [Si] | [C] | |
| SiCr | 2280 | 37.5 | 42.0 | 0.046 | |
| | | [Cr] | [Si] | [C] | [N] |
| Molten Ferr-Cr | 3540 | 62.5 | 0.4 | 0.064 | 0.012 |
| | | ($Cr_2O_3$) | ($SiO_2$) | (CaO) | $CaO/SiO_2$ |
| Slag | 6760 | 7.8 | 27.7 | 38.1 | 1.38 |
| Electric Power | 2650 (KWH/T) | | | | |
| Yield of Cr | 83.0 (%) | | | | |

As is understood from Table 6, Example 3 is also a low carbon ferro-chromium which has a nitrogen content of 0.012 wt. %, a carbon content of 0.064 wt. %, and a high Cr yield of 83.0%.

EXAMPLE 4

This example was made under the same conditions as in Example 3, except that the melt was reladled two times. Table 7, given below, shows the compositions of the primary slag, SiCr, the molten ferro-chromium, and the slag, and also shows the electric power consumed to produce one ton of Example 4 and the Cr yield of Example 4.

TABLE 7

| | Weight | Composition (wt. %) | | | |
|---|---|---|---|---|---|
| | | ($Cr_2O_3$) | (FeO) | ($SiO_2$) | (CaO) |
| Primary slag | 8090 | 32.5 | 12.4 | 2.0 | 37.0 |
| | | [Cr] | [Si] | [C] | |
| SiCr | 2340 | 37.5 | 42.0 | 0.046 | |
| | | [Cr] | [Si] | [C] | [N] |
| Molten Ferr-Cr | 3610 | 62.3 | 0.5 | 0.055 | 0.014 |
| | | ($Cr_2O_3$) | ($SiO_2$) | (CaO) | $CaO/SiO_2$ |
| Slag | 6700 | 6.8 | 29.4 | 40.9 | 1.39 |
| Electric Power | 2600 (KWH/T) | | | | |
| Yield of Cr | 84.0 (%) | | | | |

As Table 7 clearly teaches, Example 4 is also a low carbon ferro-chromium which exhibits a nitrogen content of 0.014 wt. %, a carbon content of 0.055 wt. %, and a high Cr yield of 84.0%.

INDUSTRIAL APPLICATION

According to the present invention, the low carbon ferro-chromium which has very low nitrogen content and high Cr yield can be obtained, and nitrogen content of ferro-chromium can be controlled. Thus, the low carbon ferro-chromium of high quality can be manufactured at a low cost.

We claim:

1. A method of manufacturing low carbon ferro-chromium having a low nitrogen level, comprising the steps of:

melting ores including oxides of Cr and Fe in a furnace to form a melt comprising molten slag;

pouring the molten slag into a ladle;

adding a reducing agent to the molten slag in the ladle to reduce oxides of Cr and Fe to form metallic low-carbon ferro-chromium; and introducing an oxidizing gas or an inert gas other than nitrogen or a nitrogen-containing gas into the melt in the ladle, thereby bubbling the melt and accelerating reduction of said oxides, said gas being introduced into the melt in the ladle at a rate of more than 7.0 l/min. but not exceeding 29.0 l/min., for each ton of the melt in the ladle.

2. A method of manufacturing low carbon ferro-chromium, comprising the steps of:

melting ores including oxides of Cr and Fe in a furnace to form a melt comprising molten slag;

pouring the molten slag into a ladle;

adding a reducing agent to the molten slag in the ladle to reduce oxides of Cr and Fe to form metallic low-carbon ferro-chromium;

introducing an oxidizing gas or an inert gas other than nitrogen or a nitrogen-containing gas into the melt in the ladle, thereby bubbling the melt and accelerating reduction of said oxides and lower the temperature of the melt; and reladling the melt a number of times after the temperature of the melt has been lowered by the bubbling, thereby controlling the nitrogen content of the molten metal at a low level.

3. The method of claim 2 wherein calcined lime is mixed with the oxides of Cr and Fe which are melted to form the molten slag.

4. The method of claim 3 wherein said gas in an oxidizing gas.

5. The method of claim 4 wherein said oxidizing gas is carbon dioxide.

6. The method of claim 5 wherein said reducing agent is SiCr.

7. The method of claim 2 wherein said reducing agent is SiCr.

8. The method of claim 1 wherein calcined lime is mixed with the oxides of Cr and Fe which are melted to form the molten slag.

9. The method of claim 8 wherein said gas in an oxidizing gas.

10. The method of claim 9 wherein said oxidizing gas is carbon dioxide.

11. The method of claim 10 wherein said reducing agent is SiCr.

12. The method of claim 1 wherein said reducing agent is SiCr.

* * * * *